US012546043B2

(12) United States Patent
Snook et al.

(10) Patent No.: US 12,546,043 B2
(45) Date of Patent: Feb. 10, 2026

(54) IMPELLER FOR LAUNDRY WASHING MACHINE

(71) Applicant: Midea Group Co., Ltd., Foshan (CN)

(72) Inventors: Bryan T. Snook, Louisville, KY (US); Christopher G. Hoppe, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 0 days.

(21) Appl. No.: 18/526,649

(22) Filed: Dec. 1, 2023

(65) Prior Publication Data

US 2024/0102220 A1 Mar. 28, 2024

Related U.S. Application Data

(62) Division of application No. 16/437,807, filed on Jun. 11, 2019, now Pat. No. 11,866,865.

(51) Int. Cl.
*D06F 17/10* (2006.01)
*D06F 17/08* (2006.01)
(Continued)

(52) U.S. Cl.
CPC ..... *D06F 17/10* (2013.01); *D06F 17/08* (2013.01); *D06F 23/04* (2013.01); *D06F 37/40* (2013.01); *D06F 39/083* (2013.01); *D06F 21/00* (2013.01)

(58) Field of Classification Search
CPC ..... D06F 13/00; D06F 13/02; D06F 13/04; D06F 13/06; D06F 13/08; D06F 17/00; D06F 17/06; D06F 17/10; D06F 23/00; D06F 23/02; D06F 23/025; D06F 23/04; D06F 23/06; D06F 23/065; D06F 21/00; D06F 21/02; D06F 21/04; D06F 21/06; D06F 21/08; D06F 21/10; D06F 21/12; D06F 39/083; D06F 39/10; B08B 3/044; B08B 3/045; B08B 3/047; B08B 3/10; B08B 3/102; B08B 3/104
See application file for complete search history.

(56) References Cited

U.S. PATENT DOCUMENTS 2,642,733 A 6/1953 Mccormick
3,033,015 A 5/1962 Stutrud
(Continued)

FOREIGN PATENT DOCUMENTS

CN 1203971 A 1/1999
CN 2488937 Y 5/2002
(Continued)

OTHER PUBLICATIONS

Machine Translation of Jiang et al., CN 105155193 A, Dec. 2015. (Year: 2015).*
(Continued)

*Primary Examiner* — David G Cormier
(74) *Attorney, Agent, or Firm* — Gray Ice Higdon

(57) ABSTRACT

An impeller for a laundry washing machine having one or more scooping members. The one or more scooping member may include a variety of positions relative to the impeller. The one or more scooping members may pivot to one or more positions to direct or lift fluid. The one or more scooping members may define one or more fluid pathways.

13 Claims, 4 Drawing Sheets

(51) Int. Cl.

| | |
|---|---|
| ***D06F 23/04*** | (2006.01) |
| ***D06F 37/40*** | (2006.01) |
| ***D06F 39/08*** | (2006.01) |
| *D06F 21/00* | (2006.01) |

(56) References Cited

U.S. PATENT DOCUMENTS

| | | | | |
|---|---|---|---|---|
| 3,388,570 | A | 6/1968 | Cobb | |
| 5,839,299 | A | 11/1998 | Lee | |
| 5,927,105 | A | 7/1999 | Cho | |
| 6,070,439 | A * | 6/2000 | Jung | D06F 17/10 68/53 |
| 8,448,481 | B2 | 5/2013 | Park | |
| 2012/0144877 | A1 | 6/2012 | Byrne et al. | |
| 2012/0180532 | A1 | 7/2012 | Park | |
| 2015/0033803 | A1* | 2/2015 | Carr | D06F 13/00 68/133 |
| 2020/0392659 | A1 | 12/2020 | Snook | |

FOREIGN PATENT DOCUMENTS

| | | | |
|---|---|---|---|
| CN | 2732796 | Y | 10/2005 |
| CN | 203144741 | U | 8/2013 |
| CN | 105133242 | A | 12/2015 |
| CN | 105155193 | A | 12/2015 |
| CN | 205171181 | U | 4/2016 |
| CN | 205171190 | U | 4/2016 |
| JP | 2015223318 | A | 12/2015 |
| KR | 0124394 | Y1 | 12/1998 |
| KR | 20010000993 | A | 1/2001 |
| KR | 20010111543 | A | 12/2001 |
| WO | 2019120117 | A1 | 6/2019 |
| WO | 2020248921 | A1 | 12/2020 |

OTHER PUBLICATIONS

International Search Report and Written Opinion issued in Application No. PCT/CN2020/094816, 9 pages, dated Sep. 23, 2020.

* cited by examiner

IMPELLER FOR LAUNDRY WASHING MACHINE

BACKGROUND

The present embodiments relate to a laundry washing machine, more specifically an impeller for a laundry washing machine.

Typical wash drums with a rotating wash plate or impeller may twist back and forth and/or rotate relative to the surrounding wash drum to rub or contact clothes against each other. This practice of using an impeller generates the washing water flow to separate dirt from the clothes by friction between the water flow above the impeller and/or the clothing. Thus, there is a need to direct or lift fluid surrounding (e.g. below) the impeller to aid friction, cleaning characteristics, and/or fluid flow characteristics to clean the clothes.

SUMMARY

In some embodiments of the invention, for example, an impeller for a laundry washing machine may include a rotating member having one or more openings extending from a top surface to a bottom surface. In various embodiments, the rotating member may be positioned within a wash drum. In some embodiments, at least one scooping member may be positioned within the one or more openings and may be positionable between at least a first position and a second position. In various embodiments, wherein in the first position the opening may define a first fluid pathway from the bottom surface to the top surface and wherein in the second position the opening may define a second fluid pathway different from the first fluid pathway.

In some embodiments, at least one scooping member may be in the first position when the rotating member rotates in a first rotational direction. In various embodiments, at least one scooping member may be in the second position when the rotating member rotates in a second rotational direction opposite to the first rotational direction. In addition, in some embodiments, at least one scooping member may project below the bottom surface of the rotating member when in one or more of the first position and the second position. In various embodiments, the impeller may include a cover positioned on the top surface of the rotating member and disposed over at least one scooping member and the one or more openings. In some embodiments, the cover may define one or more second openings in fluid communication with the one or more openings of the rotating member. In various embodiments, one or more of the first fluid pathway and the second fluid pathway may be open to fluid communication between the bottom surface and the top surface. Moreover, in some embodiments, wherein when the rotating member is rotating in one or more rotational directions, the first fluid pathway and the second fluid pathway may be open to fluid communication between the bottom surface and the top surface. In various embodiments, at least one scooping member pivots between the first position and the second position.

In some embodiments, an impeller for a laundry washing machine may include a rotating member within a wash drum having one or more openings extending from a top surface to a bottom surface of the rotating member. In various embodiments, the rotating member may include one or more scooping members positioned adjacent the one or more openings of the rotating member to define one or more fluid pathways through the one or more openings between the bottom surface and the top surface of the rotating member.

In addition, in various embodiments, the one or more scooping members may define a first fluid pathway of the one or more fluid pathways when the rotating member rotates in a first rotational direction and a second fluid pathway of the one or more fluid pathways when the rotating member rotates in a second rotational direction opposite to the first rotational direction, and wherein the second fluid pathway is different from the first fluid pathway. In some embodiments, the one or more scooping members may pivot into and out of the opening defined by the bottom surface of the rotating member in at least one rotational direction of the rotating member. In various embodiments, the impeller may include a cover positioned over the one or more scooping members and projecting from the top surface of the rotating member. In some embodiments, one or more scooping members may include a top surface and a bottom surface, wherein the top surface includes one or more arcuate surfaces. In various embodiments, the top surface of the one or more scooping members may include opposing arcuate surfaces of the one or more arcuate surfaces on lateral sides of a pivoting axis of the one or more scooping members. In addition, in some embodiments, the impeller may include a laundry washing machine with a wash drum therein.

Other embodiments may include the method of directing fluid from beneath an impeller of a laundry washing machine. In some embodiments, the method may include rotating at least one rotating member of the impeller in a first rotational direction, wherein at least one rotating member includes at least one scooping member proximal an opening of at least one rotating member. In various embodiments, the method may include directing fluid from between a bottom surface of at least one rotating member and a wash drum upwardly through the opening of at least one rotating member with at least one scooping member when rotating at least one rotating member of the impeller in the first rotational direction.

In addition, in some embodiments, the method may include pivoting a leading edge of at least one scooping member downwardly and into a space between the bottom surface of at least one rotating member and the wash drum in the first rotational direction. In various embodiments, the method may include pivoting at least one scooping member to a first position when rotating at least one rotating member in the first rotational direction. Moreover, in various embodiments, the method may include pivoting at least one scooping member to a second position when rotating at least one rotating member in a second rotational direction opposite to the first rotational direction. In some embodiments, the method may include directing fluid upwardly and in a direction opposite to the first rotational direction. In various embodiments, the method may include directing fluid from between the bottom surface of at least one rotating member and the wash drum occurs in both the first rotational direction and in a second rotational direction opposite to the first rotational direction.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques within a top-load residential laundry washing machine such as laundry washing machine 10, such as the type that may be used in single-family or multi-family dwellings, or in other similar applications. However, it will be appreciated that the herein-described techniques may also be used in connection with other types of laundry washing machines in some embodiments. For example, they may be used in commercial applications in some embodiments. Moreover, they may be used in connection with other laundry washing machine configurations. For example, a front-load laundry washing machine that includes a front-mounted door in a cabinet or housing that provides access to a horizontally-oriented wash drum housed within the cabinet or housing may be used. Implementation of the herein-described techniques within a front-load laundry washing machine would be well within the abilities of one of ordinary skill in the art having the benefit of the instant disclosure, so the invention is not limited to the top-load implementation discussed further herein.

Figure 1:
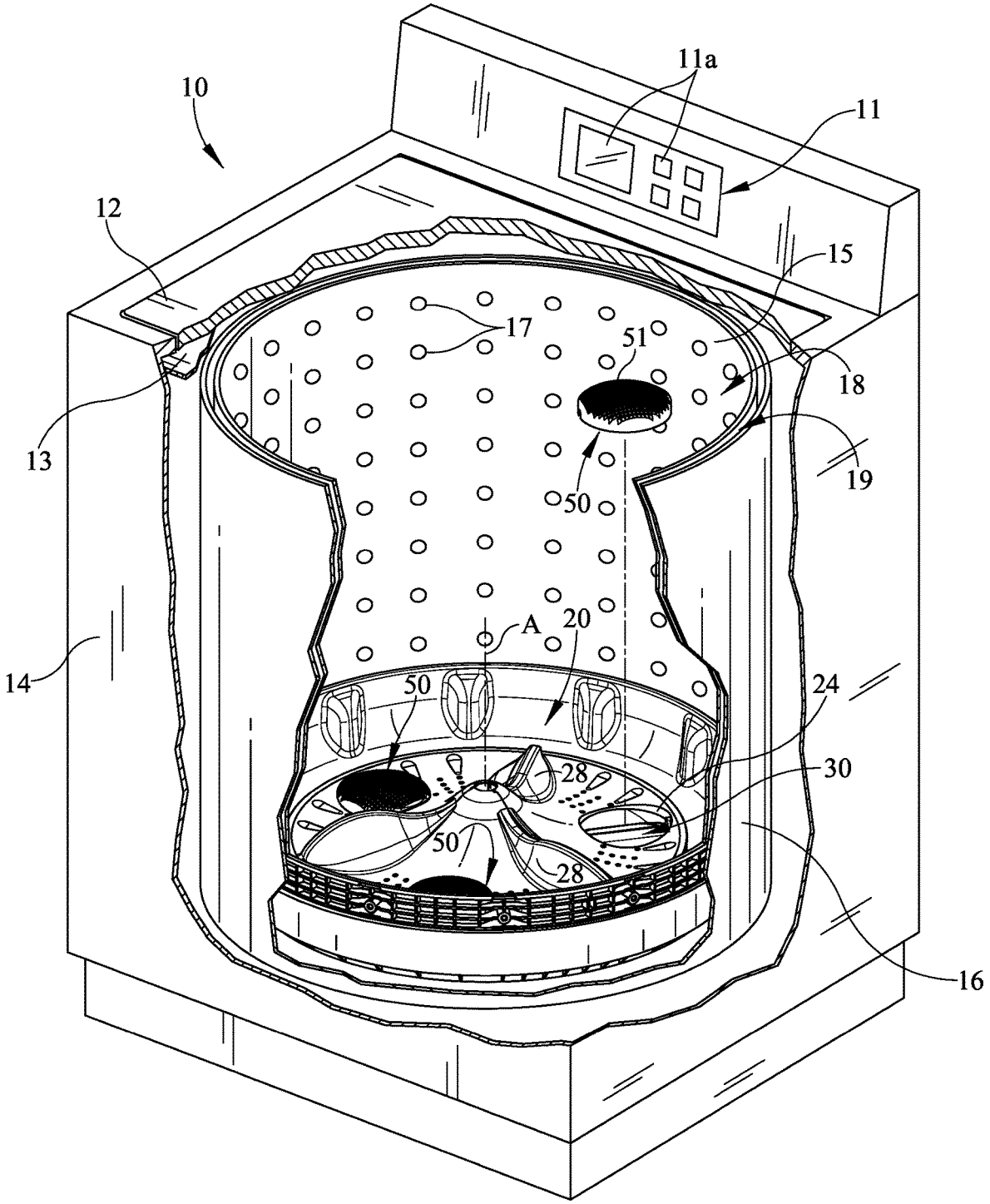
FIG. 1 is a perspective view of one embodiment of a wash drum and an impeller with portions of an embodiment of the laundry washing machine broken away.

Turning now to the drawings, wherein like numbers denote like parts throughout the several views, FIG. 1 illustrates an example laundry washing machine 10 in which the various technologies and techniques described herein may be implemented. Laundry washing machine 10 is a top-load washing machine, and as such includes a top-mounted door 12 in a cabinet or housing 14 defining an opening 13 that provides access to a vertically-oriented wash drum or basket 15 and wash tub 16 housed within the cabinet or housing 14. Door 12 is generally hinged along a side or top edge and is pivotable between the opened position (not shown) and a closed position illustrated in FIG. 1. When door 12 is in the opened position, clothes and other washable items may be inserted into and removed from the wash chamber within the wash drum 15 through the opening 13 in the top of cabinet or housing 14. The wash tub 16 houses the wash drum 15 that includes a plurality of perforations 17. In some embodiments, a drive system rotates the wash drum 15 via a trunnion relative to the wash tub 16, wherein a liquid may be circulated within the wash tub 16, and thereby the wash drum 15, with an amount of liquid to at least partially submerge the fabric load. Rotation of the wash drum 15 imparts mechanical energy to the liquid and to the fabric articles to move the articles within the wash chamber. The wash chamber 18 within the wash drum 15 defines a wash capacity or volume.

Disposed within wash tub 16 is the wash drum 15 and/or impeller 20 that is rotatable about a generally vertical axis A by one or more drive systems. Wash drum 15 is generally perforated or otherwise provides fluid communication between the wash chamber 18 of the wash drum 15 and a space 19 between wash drum 15 and wash tub 16. The drive system(s) may include, for example, an electric motor and a transmission and/or clutch for selectively rotating the wash drum 15 and/or impeller 20. In some embodiments, the drive system may be a direct drive system, whereas in other embodiments, a belt or chain drive system may be used.

In some implementations, as the one shown, embodiments of the impeller 20, disposed in the interior or wash chamber 18 of wash drum 15 may agitate items within wash drum 15 during one or more washing operations. Impeller 20 may be driven by the drive system, e.g., for rotation about the same axis A as wash drum 15, and a transmission and/or clutch within drive system may be used to selectively rotate impeller 20. In other embodiments, separate drive systems may be used to rotate wash drum 15 and impeller 20. Implementation of the herein-described techniques within an agitator would be well within the abilities of one of ordinary skill in the art having the benefit of the instant disclosure, so the invention is not limited to the impeller implementation discussed further herein. Other agitators such as an auger or other agitation element may be used in some embodiments.

In some embodiments, control over washing machine 10 by a user is generally managed through a control panel 11 and/or remote device. The control panel 11 may be disposed on one or more surfaces of the machine 10 and implementing a user interface 11*a*. It will be appreciated that in different washing machine designs, control panel 11 may include various types of input and/or output devices, including various knobs, buttons, lights, switches, textual and/or graphical displays, touch screens, etc. through which a user may configure one or more settings or cycles.

As is shown in the Figures, the impeller 20 embodiment illustrated may include one or more scooping or lifting members 30 forcing water or fluid surrounding the impeller 20 upwardly and/or through the impeller 20 towards the articles of clothing within the wash chamber 18. The one or more scooping members 30 may direct water from below or beneath the impeller 20, more specifically a space 40 between the impeller 20 (e.g. a bottom surface 21) and the wash drum 15, to a top surface 22 of the impeller. This fluid occupying the space 40 between the bottom surface 21 of the impeller and the wash drum 15 may be forced, propelled, or channeled in a variety of directions and/or speeds (e.g. upwardly, opposite rotation, with rotation, radially inward, radially outward, etc.) through one or more fluid pathways 42, 44 through the impeller 20 and/or rotating/plate member 23 to create a variety of fluid flow/cleaning characteristics to increase cleaning performance or efficiency. Some advantages may be, but is not limited to, lowering the water level for washing without increasing wear on the clothing or reducing performance, increase the mixing of detergent/water, increase the turnover of clothing, increase mechanical action, increase bubble generation, etc.

Figure 3:
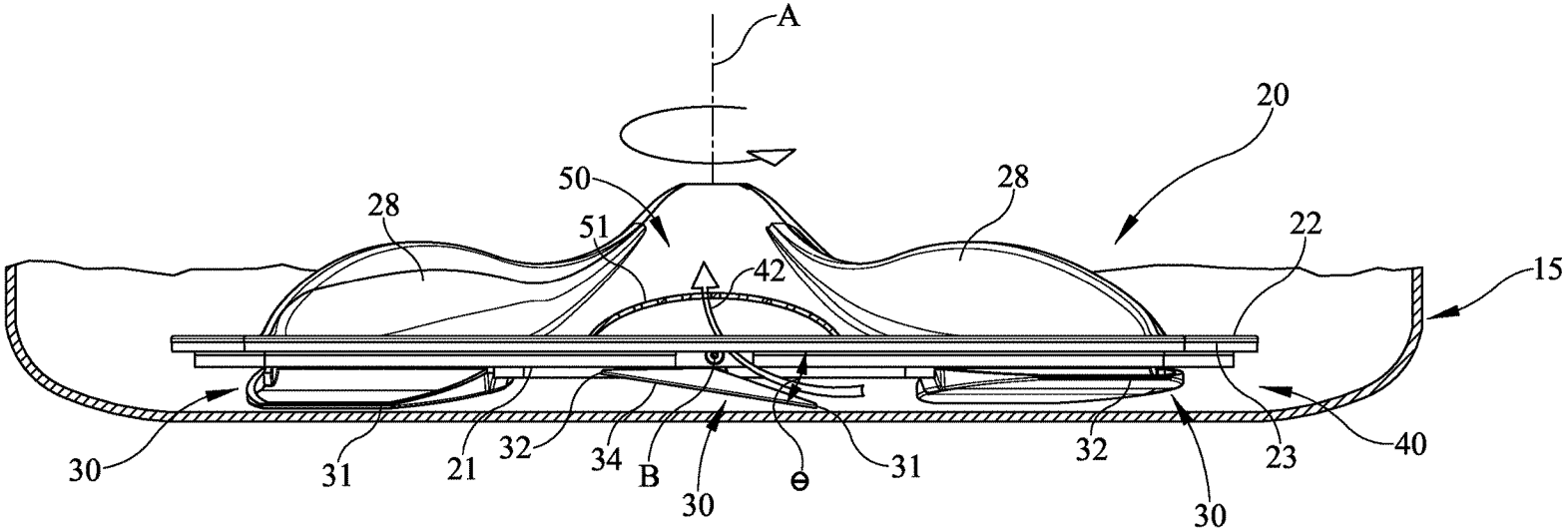
FIG. 3 is a side view of the wash drum and impeller of FIG. 2 illustrating an embodiment of the fluid flow during rotation of the impeller.
Figure 4:
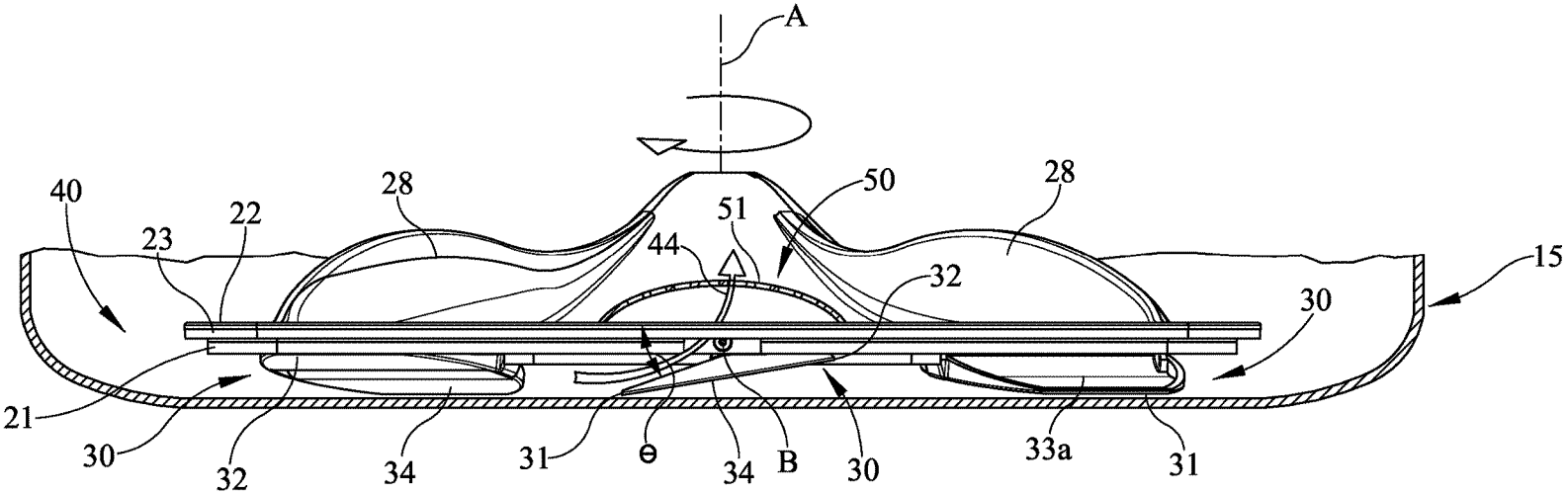
FIG. 4 is a side view of the wash drum and impeller of FIG. 3 illustrating n embodiment of the fluid flow during opposite rotation of the impeller.
Figure 5:
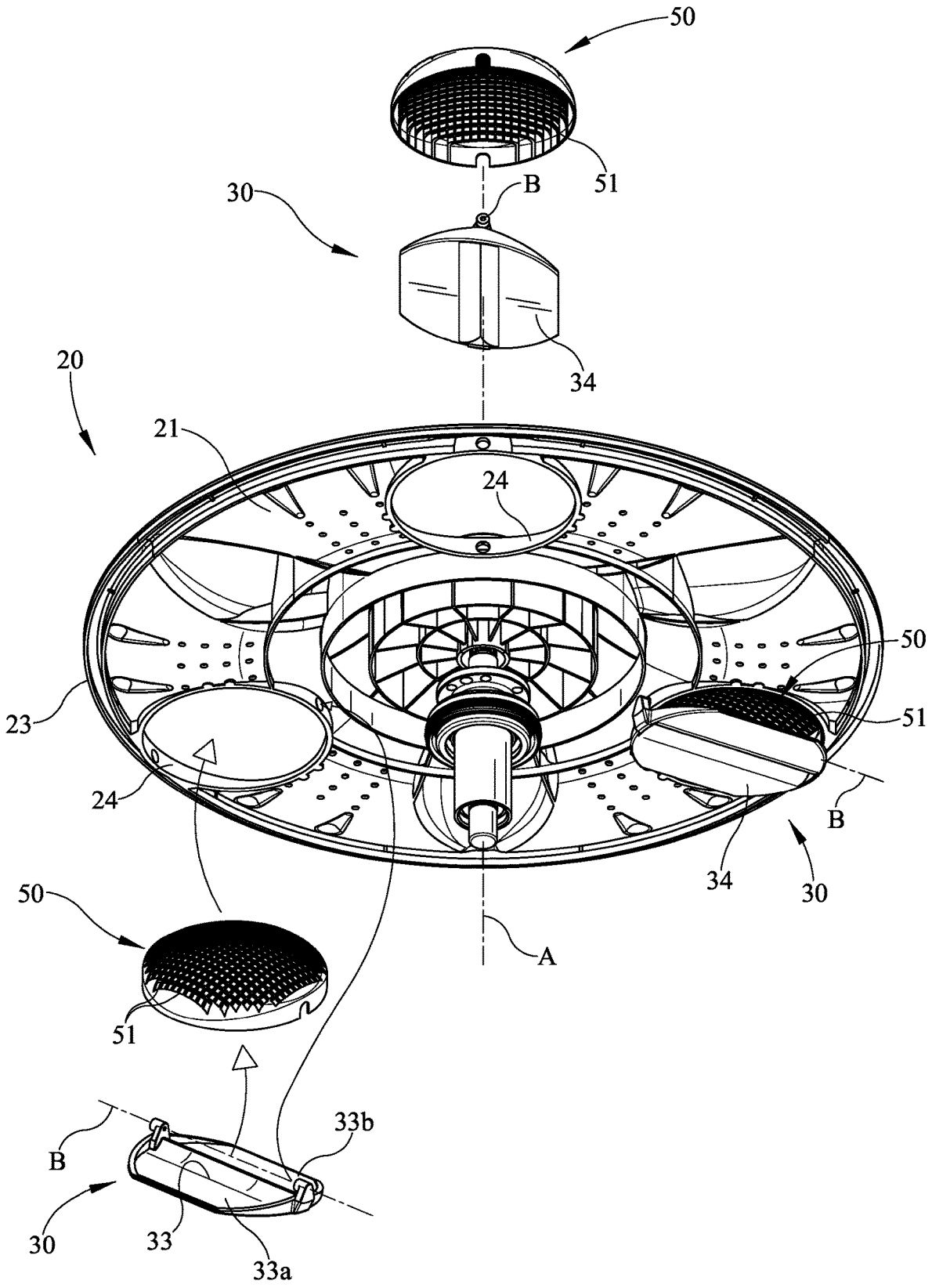
FIG. 5 is an exploded view of the impeller of FIG. 1.

In some implementations, the one or more scooping members, lifters, or diverters 30 may funnel or propel fluid upwardly through one or more openings 24 within the impeller 20 or rotating member 23 towards the clothing or other articles. The one or more openings 24, defining at least a portion of the fluid pathways 42, 44, may extend through the impeller 20 (e.g. from the bottom surface 21 to the top surface 22) or portions thereof. The scooping member 30 directs fluid from the space 40 between the bottom surface 21 of the impeller 20 upwards through the opening 24 towards the top surface 22. The one or more scooping members 30 may direct or channel the fluid when the impeller 20 or rotating member 23 rotates in one or more rotational directions (e.g. clockwise and/or counter clockwise) about the axis A. For example, as illustrated in FIG. 3, one or more scooping members 30 may direct or lift fluid through the impeller 20 (e.g. beneath, sides, outer periphery, etc.) when the impeller rotates or twists in a first rotational direction (e.g. counter clockwise). Moreover, as shown in FIG. 4, the same or another one or more scooping members 30 within the impeller 20 may direct fluid though the impeller when the impeller rotates or twists in a second rotational direction (e.g. clockwise) or opposite direction of the first rotational direction. Further, it should be understood that a single scooping member 30 may direct fluid or lift fluid from the bottom surface 21 or space 40 in a single rotational direction instead of two rotational directions. One or more scooping members 30 of the impeller 20 may be the same or different in size, shape, construction, quantities, positions within the impeller, and still direct fluid in one or more fluid pathways or directions when rotating/twisting in one or more rotational directions and still be within the scope of the invention.

The one or more scooping members 30 may be a variety of constructions adjacent the opening 24. Although the pathway, bore, or opening 24 may extend substantially parallel to the axis A of rotation as shown in FIGS. 3 and 4, the opening 24 through the impeller 20 may be a variety of shapes, sizes, quantities, constructions within the rotating member. For example, the opening 24 may narrow upwardly, narrow downwardly, be orientated transverse to the axis A, arcuate in shape, angled between the top and bottom surfaces 22, 21, slotted, etc. At least one scooping member 30 may be positioned within or proximal the opening 24 in the impeller 20 or rotating member 23. The scooping member 30 may project below the bottom surface 21 of the rotating member 23 in the one or more rotational directions. The scooping member 30 may define one or more fluid pathways 42, 44 between the bottom surface 21 and the top surface 22 of the impeller 20 or rotating member 23. In some embodiments, the scooping member 30 or portions thereof may project from or below the bottom surface 21 of the rotating member in one or more positions. Moreover, in some embodiments, the scooping member may project upward or above the top surface 22 in one or more positions. The scooping member 30 may include a leading edge 31 (e.g. in the direction of rotation of the impeller) depending from or proximal the bottom surface 21 or positioned below a trailing edge 32 of the scooping member. The leading edge 31 of the scooping member 30 may be at an elevation below the trailing edge 32 or a portion of the bottom surface 21 of the impeller defining the opening 24 such that the leading edge 31 projects into a horizontal plane or elevation of the space 40 containing fluid. Whereby the scooping member 30 or leading edge 31 carves out, withdraws, lifts, or channels fluid from one elevation below the impeller (e.g. bottom surface 21) and directs/funnels the fluid (e.g. upwardly and/or away from the direction of rotation of the impeller) to an elevation above the top surface 33 of the rotating member 23.

One or more of the scooping members 30 may include a fixed orientation or position. In some implementations, one or more of the scooping members 30 may be fixed in orientation relative to the rotating member 23. At least one scooping member 30 may be fixed to lift or direct fluid (e.g. upwardly through the rotating member) in at least one rotational direction (e.g. clockwise or counterclockwise). In some embodiments, the impeller 20 may include one or more first scooping members fixed to lift or direct fluid when the rotating member rotates in the one rotational direction and/or one or more second scooping member fixed to lift or direct fluid with the rotating member rotates in the other or opposing rotational direction. Alternatively, it should be understood that one or more positionable or movable scooping members may be releasably fixed in one or more positions or orientations, if desired, to lift in one or more rotational directions of the rotating member. For example, a locking mechanism (e.g. pin, lock, catch, or releasable device) may fix the position of the scooping member per the application or desired fluid flow characteristic in one or more rotational directions. Moreover, the fixed position may be released manually and/or automatically if and when conditions are met.

In some implementations, the movable scooping members 30 (e.g. pivoting scooping members) may be adjusted, set, or limited to one or more angles/directions/orientations as desired or predetermined for an application corresponding to one or more positions within a range of positions available for one or more rotational directions of the impeller. In some embodiments, a selection by the user, the article(s) being sensed, soiled conditions are sensed, and/or the washing cycle may control the angle, projected depth of the scooping member from the bottom surface 21, and/or position/orientation of the scooping member to adjust the direction and/or amount of fluid lifted from the space 40 from a range of available angles, inner flow diameters, openings, pathways, desired flow/cleaning characteristics, etc. In some embodiments, the scooping members and their corresponding position when the impeller rotates in one or more rotational directions may be manually set or selected by a user from a variety of positions available. Alternatively, as in the one embodiment shown, the scooping members and their positions may be automatically controlled or predetermined relative to the impeller, scooping member, or appliance characteristics. In the one embodiment shown in the Figures, the scooping member 30 may be constructed to rest at a first/home position (FIG. 3) defining a first fluid pathway 42 when rotating and rest at a second/home position (FIG. 4) defining a second fluid pathway 44 when rotating in the opposite direction.

In some implementations, one or more of the scooping members 30 may be positionable or moved between one or more positions. The one or more positions may define one or more fluid pathways 42, 44. In the one embodiment shown, the scooping member 30 may pivot between one or more positions or orientations within the opening 24. The scooping member 30 may pivot into and/or out of the opening 24 defined by the bottom surface 21 of the rotating member 23 in one or more rotational directions. In the one embodiment shown, the scooping member 30 pivots between a first position (see FIG. 3) defining the first fluid pathway 42 within the opening 24 and a second position (see FIG. 4) defining the second fluid pathway 44 within the opening 24. In some embodiments, the first fluid pathway 42 may be different from the second fluid pathway 44. As shown in FIG. 3, when the impeller 20 or rotating member 23 rotates in the counter clockwise direction or first rotational direction, the scooping member 30 defines, at least in part, the first fluid pathway 42 from the bottom surface 21 to the top surface 22. In the one embodiment shown, the first fluid pathway 42 may be upwardly and away (e.g. clockwise) from the first rotational direction (e.g. counter clockwise). As shown in FIG. 4, when the impeller 20 or rotating member 23 rotates in the clockwise direction or second rotational direction, the scooping member 30 defines, at least in part, the second fluid pathway 44 from the bottom surface 21 to the top surface 22. In the one embodiment shown, the second fluid pathway 44 may be upwardly and away (e.g. counter clockwise) from the second rotational direction (e.g. clockwise). Although the angle θ or orientation of the scooping member 30 relative to the bottom surface 21 of the rotating member 23 is the same in both the first and second positions, the angle θ may be different in some embodiments. Moreover, two or more scooping members 30 in the impeller 20 may have the same or different positions in the one or more rotational direction of the rotating member and correspondingly define the same or different fluid pathways. Although the one embodiment shown includes at least the first fluid pathway 42 and the second fluid pathway 44 to be open in fluid communication between the bottom surface 21 and the top surface 22 of the rotating member 23, it should be understood that one of the scooping member's position and corresponding fluid pathway/opening may be zero or closed such that fluid is not lifted in some embodiments during rotation. For example, in some embodiments, the fluid pathway or scooping member may be in a closed first position and may not lift fluid when the rotating member is rotating in one rotational direction and may be in an open second position allowing fluid flow when the rotating member is rotating in an opposing rotational direction. Moreover, in some embodiments, the one or more scooping members 30 may be positionable between more than two positions and still be within the scope of the invention to achieve desired flow/cleaning characteristics.

Although the scooping member 30 pivots in the one embodiment shown, the scooping member may be positionable or moveable between a plurality of positions in a variety of different methods/constructions and still lift/direct fluid from below the bottom surface 21 of the impeller 20 or portion thereof. For example, a scooping member may slide/translate between positions when the impeller rotates. Moreover, in some implementations, the scooping member 30 may operate between one or more positions without impeller or rotating member's rotation. For example, the scooping member may be urged to one or more positions by a bias mechanism (e.g. spring). In another example, wash drum rotation or another portion of the appliance may propel water with the one or more scooping members with or without impeller rotation. Further, one or more scooping members may propel fluid downward if desired.

In some implementations, the impeller 20 may include fixed scooping members, reconfiguring/movable scooping members 30 (e.g. pivoting), or a combination thereof. For example, in some embodiments, the rotating member 23 may include one or more fixed scooping members and/or one or more pivoting/movable scooping members. In the embodiment shown in FIGS. 3 and 4, the plurality of scooping members 30 are pivotable between the first and second positions relative to the rotational direction (e.g. counter clockwise or clockwise) of the impeller 20 or rotating member 23.

Figure 2:
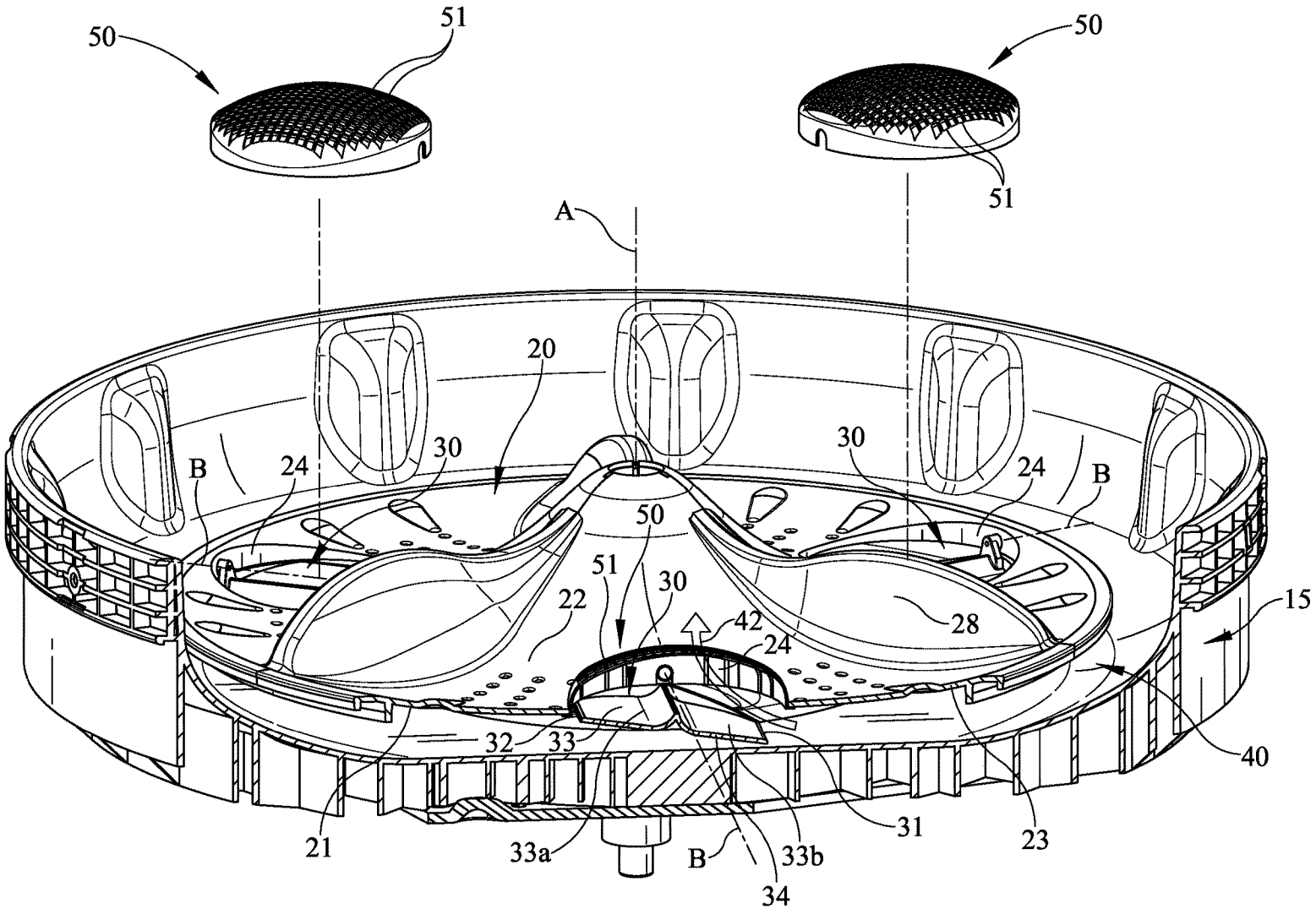
FIG. 2 is a perspective view of the wash drum and impeller of FIG. 1 with portions of the impeller and wash drum broken away.

In some implementations, the impeller 20 and/or scooping member 30 may include one or more covers 50. The cover 50, if used, may reduce articles of clothing from being held within the opening/scooping members. The cover 50 may be positioned on or project from the top surface 22 of the rotating member 23. The cover 50 may be disposed over at least a portion of the scooping member(s) 30 and/or the one or more openings 24. As shown in FIGS. 2-4, the cover 50 may include one or more openings 51 therein in fluid communication with the one or more fluid pathways 42, 44 and/or openings 24 defined by the one or more scooping members 30. The cover 50 may be a domed screen as shown in the one embodiment. The cover/scooping members/one or more openings may be positioned between the vanes 28 as shown in the one embodiment. It should be understood that the cover 50 may be a variety of shapes, sizes, quantities, and constructions and still be within the scope of the invention. For example, the cover may be utilized as a vane or auxiliary vane to agitate or collide with the water flow alone or in combination with other vane constructions.

The scooping member 30 may be a variety of constructions and still direct or lift water upwardly towards the articles of clothing from the space 40 beneath the impeller 20. One or more portions of the scooping member 30 may define the one or more fluid pathways 42, 44 along with other structures of the impeller and/or appliance. In the one embodiment shown, the scooping member 30 may include a top surface 33 and a bottom surface 34. The top surface 33 may include one or more cam surfaces 33*a*, 33*b* contacting the fluid during rotation of the rotating member to drive the scooping member between the positions, if any movement, (e.g. pivoted positions) about a hinge or axis B. Each arcuate surface 33*a*, 33*b* (e.g. top surface or scooping member portions) adjacent the leading edge 31 in the direction of the impeller rotation may be pushed downwardly by the opposing rotational fluid forces applied thereto in reaction to the rotational direction(s) of the impeller. The one or more top/cam surfaces may propel or lift the fluid upwardly from the space 40. The cam surfaces 33*a*, 33*b* may be one or more arcuate surfaces. As shown in the one embodiment, the arcuate/cam surfaces 33*a*, 33*b* may straddle or be on lateral sides of the pivoting axis B. The cam surfaces 33*a*, 33*b* may be opposing to each other to propel the water or fluid from beneath the impeller upward.

In use, the rotating member 23 rotates relative to the axis A via the drive system in one or more rotational directions. The scooping member 30, if not already pivoted or fixed in position, may pivot to a lifting position or pivot into the space 40 between the bottom surface 21 of the impeller 20 and the surrounding wash drum 15. During the rotation of the impeller 20, the scooping member 30 lifts or directs the fluid upwardly from the space 40 and into the wash chamber 18 above the top surface 22 of the impeller 20 or rotating member 23 in one or more fluid pathways 42, 44. The scooping member 30 directs the fluid between the bottom surface 21 of the rotating member 23 and the wash drum 15 through the opening 24 or portions thereof of the rotating member and/or scooping member. The leading edge 31 or portion of the scooping member 30 may be positioned within the space 40 between the bottom surface 21 of the rotating member 23 and the wash drum 15 in the one or more rotational directions. With the scooping member 30 proximal the opening 24 of the rotating member, the fluid may be directed upwardly and/or in a direction opposite to the rotational direction of the rotating member 23. However, a variety of fluid pathways propelled by the scooping members may be configured or constructed in the one or more rotational directions. The lifted or propelled water may provide more water motion and/or mixing. The clothes may turn over more with the lifting water/fluid. When the impeller or agitator changes rotational direction, the scooping member, if not fixed, may pivot or move to another or second/lifting position having another or second fluid flow path (e.g. different, same, combination/overlap, etc.). As shown in FIG. 3, the scooping member 30 may pivot to the first position when rotating the impeller or portions thereof in the first rotational direction. The scooping member, in the one embodiment shown in FIG. 4, may pivot to the second position when rotating the impeller or portions thereof in the second rotational direction different from or opposite to the first rotational direction. With one or more rotational directions occurring for one or more rotating members, one or more of the same or different scooping members may operate during one or both rotational directions. Each scooping member may define one or more fluid pathways and/or one or more positions different or the same from another scooping member in various embodiments to create a variety of flow/cleaning characteristics as desired. For example, a single scooping member may operate or be in open fluid communication to lift fluid in a single rotational direction and another scooping member may be in open fluid communication in the opposite rotational direction creating different fluid flow paths depending on the rotational direction of the rotating member.

Although an embodiment of the cover 50, scooping member 30, and/or impeller 20 is shown in the figures, it should be understood that they may be a variety of shapes, sizes, quantities, and constructions and still be within the scope of the invention.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure. In some embodiments, All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of" or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding,"

"composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A laundry washing machine having an impeller, the impeller comprising:

a rotating member having a top surface and a bottom surface, wherein the rotating member is positioned within a wash drum and having one or more vanes projecting upwardly from the top surface, and wherein the rotating member includes one or more openings positioned circumferentially between two adjacent vanes and extending from the top surface to the bottom surface of the rotating member;

at least one scooping member is positioned within the one or more openings in a fixed depending position from the bottom surface of the impeller and directing fluid from beneath the rotating member upwardly above the rotating member; and wherein the at least one scooping member is positioned at an acute angle relative to the bottom surface of the impeller, wherein the at least one scooping member includes a top surface and an opposing bottom surface extending at the acute angle between a trailing edge and a leading edge of the at least one scooping member, and wherein the top surface of the at least one scooping member includes at least one arcuate surface.

2. The laundry washing machine of claim 1 wherein a first scooping member of the at least one scooping member defines a first fluid pathway when the rotating member rotates in a first rotational direction.

3. The laundry washing machine of claim 2 wherein a second scooping member of the at least one scooping member defines a second fluid pathway when the rotating member rotates in a second rotational direction opposite to the first rotational direction.

4. The laundry washing machine of claim 2 wherein the first fluid pathway is open to fluid communication between the bottom surface and the top surface.

5. The laundry washing machine of claim 1 further comprising a cover positioned on the top surface of the rotating member and disposed over the at least one scooping member and the one or more openings.

6. The laundry washing machine of claim 5 wherein the cover defines one or more second openings in fluid communication with the one or more openings of the rotating member.

7. The laundry washing machine of claim 1 wherein the leading edge of the at least one scooping member is spaced away from and below the bottom surface of the rotating member.

8. The laundry washing machine of claim 1 wherein the top surface of the at least one scooping member includes two of the at least one arcuate surfaces.

9. A laundry washing machine having an impeller, the impeller comprising:

a rotating member within a wash drum and rotates about an axis and having one or more openings extending from a top surface to a bottom surface of the rotating member parallel to the axis, wherein the one or more openings are adjacent an outer periphery of the rotating member;

wherein the rotating member includes at least one diverter, the at least one diverter is fixed in position within the one or more openings of the rotating member to define one or more fluid pathways through the one or more openings from the bottom surface to the top surface;

the at least one diverter extends downwardly from the bottom surface below the one or more openings of the rotating member towards at least one rotational direction to define a first fluid pathway of the one or more fluid pathways through the one or more openings extending through the bottom surface and the top surface; and wherein the at least one diverter is angled downwardly below the one or more openings transversely to the axis, wherein a trailing edge of the at least one diverter is adjacent the one or more openings and a free leading edge of the at least one diverter is distal from the one or more openings at a lower elevation than the trailing edge.

10. The laundry washing machine of claim 9 wherein the at least one diverter is releasably fixed in one or more positions and/or orientations relative to the rotating member.

11. The laundry washing machine of claim 9 wherein the at least one diverter includes a top surface and a bottom surface extending between the trailing edge and the leading edge, wherein the top surface of the at least one diverter includes one or more arcuate surfaces to define the first fluid pathway of the one or more fluid pathways through the one or more openings extending through the bottom surface and the top surface of the rotating member.

12. The laundry washing machine of claim 11 wherein the one or more arcuate surfaces of the top surface of the at least one diverter is curved in the at least one rotational direction between the leading edge and the trailing edge.

13. The laundry washing machine of claim 11 wherein the one or more arcuate surfaces of the top surface of the at least one diverter is concave in cross section.

* * * * *